US006550239B2

(12) United States Patent
Almkvist et al.

(10) Patent No.: US 6,550,239 B2
(45) Date of Patent: Apr. 22, 2003

(54) METHOD OF REDUCTION OF EXHAUST GAS EMISSIONS FROM INTERNAL COMBUSTION ENGINES

(75) Inventors: Göran Almkvist, Gåabo (SE); Krister Fredriksson, Kyrkesund (SE)

(73) Assignee: Volvo Car Corporation, Göteborg (SE)

( * ) Notice: Subject to any disclaimer, the term of this patent is extended or adjusted under 35 U.S.C. 154(b) by 0 days.

(21) Appl. No.: 09/682,432

(22) Filed: Aug. 31, 2001

(65) Prior Publication Data

US 2002/0033016 A1 Mar. 21, 2002

Related U.S. Application Data

(63) Continuation of application No. PCT/SE00/00397, filed on Feb. 29, 2000.

(30) Foreign Application Priority Data

Mar. 5, 1999 (SE) ..... 9900808

(51) Int. Cl.[7] ..... F01N 3/00

(52) U.S. Cl. ..... 60/284; 60/274; 60/285; 123/192.1; 123/339.14

(58) Field of Search ..... 60/274, 277, 284, 60/285; 123/2, 192.1, 192.2, 179.16, 179.3, 339.1, 339.14, 339.16, 339.17, 339.18; 290/40 A, 22

(56) References Cited

U.S. PATENT DOCUMENTS 4,467,761 A * 8/1984 Hasegawa ..... 123/339.18
4,501,240 A 2/1985 Aono
4,520,272 A * 5/1985 Danno et al. ..... 123/339.18
4,699,097 A * 10/1987 Tanaka et al. ..... 123/192.1
4,803,376 A * 2/1989 Nguyen ..... 290/22
5,020,491 A * 6/1991 Mashino ..... 123/192.1
5,614,809 A 3/1997 Kiuchi et al.
5,703,410 A * 12/1997 Maekawa ..... 123/339.16
5,752,387 A * 5/1998 Inagaki et al. ..... 123/339.17

FOREIGN PATENT DOCUMENTS

| | | | |
|---|---|---|---|
| DE | 4015701 | A1 | 11/1990 |
| DE | 19704153 | A1 | 8/1998 |
| EP | 0646723 | B1 | 4/1995 |
| EP | 0660501 | A1 | 6/1995 |
| EP | 0727574 | A1 | 8/1996 |
| EP | 0743211 | A2 | 11/1996 |
| EP | 0787897 | A2 | 8/1997 |

* cited by examiner

*Primary Examiner*—Thomas Denion
*Assistant Examiner*—Tu M. Nguyen
(74) *Attorney, Agent, or Firm*—Howrey Simon Arnold & White LLP

(57) ABSTRACT

A method for reducing harmful and toxic exhaust gases from an internal combustion engine. The engine includes at least one cylinder to which an air/fuel mixture is supplied when a crankshaft of the internal combustion engine is rotated. The method includes supplying an air/fuel mixture with a lambda value greater than one to the cylinder, and controlling the pressure in the intake channel by an electric motor/generator coupled to the crankshaft. When the pressure in the intake channel exceeds a predetermined pressure, the electric motor/generator is controlled in such a way that the pressure in the intake channel can decrease, and when the pressure in the intake channel falls below a predetermined pressure, the electric motor/generator is controlled in such a way that the pressure in the intake channel can increase.

24 Claims, 3 Drawing Sheets

METHOD OF REDUCTION OF EXHAUST GAS EMISSIONS FROM INTERNAL COMBUSTION ENGINES

CROSS REFERENCE TO RELATED APPLICATIONS

This is a continuation patent application of International Application Number PCT/SE00/00397 filed Feb. 29, 2000 that designates the United States. The full disclosure of said application, in its entirety, is hereby expressly incorporated by reference into the present application.

BACKGROUND OF INVENTION

1. Technical Field

The present invention relates to internal combustion engines and their related exhaust emissions. More specifically, the present invention discloses a method for reducing harmful and toxic exhaust gases from an internal combustion engine having at least one cylinder supplied with an air/fuel mixture when a crankshaft of the internal combustion engine is rotated.

2. Background Information

In internal combustion engines it is desirable to reduce the harmful and toxic substances that occur in the exhaust gases of the internal combustion engine in order to reduce the burden on the surrounding environment, as well as comply with the legal requirements placed on internal combustion engines. Substances that are found in exhaust gases include carbon monoxide ("CO"), hydrocarbons ("HC") and nitrogen oxides ("$NO_x$").

In order to reduce these substances from the exhaust gases, the internal combustion engine is provided with a catalyzer or catalytic converter that chemically converts these substances to those which do not adversely affect the surrounding environment. However, this chemical reaction occurs only when the catalytic converter has reached a predetermined working temperature, which is reached after a predetermined running time of the internal combustion engine. Therefore, when cold-starting the internal combustion engine, no reduction of the toxic substances takes place in the catalytic converter.

Another problem that occurs when cold-starting internal combustion engines is that a relatively large amount of fuel in relation to the supplied air, i.e., a rich air/fuel mixture, must be supplied to the internal combustion engine in order for the internal combustion engine to be able to start and to be able to operate at a substantially constant rotation speed during idling. This rich air/fuel mixture is also supplied so that the internal combustion engine will be able to provide an increased torque upon acceleration. As such, running of the internal combustion engine is guaranteed before the internal combustion engine has reached its operating temperature.

The absence of the exhaust gas cleaning by the catalytic converter and the rich air/fuel mixture means that the levels of CO, HC and $NO_x$ emitted from the internal combustion engine are high upon cold-starting of the internal combustion engine. Attempts have previously been made to reduce the fuel quantity in relation to the air supplied, i.e., drive the internal combustion engine with a leaner air/fuel mixture upon cold-starting. However, this results in the internal combustion engine working very unevenly during idling, and a poor drivability of the internal combustion engine. The reason why rotation speed varies during idling is that the internal combustion engine torque is very sensitive to variations in the lambda value of the air/fuel mixture supplied to the internal combustion engine cylinder space when the air/fuel mixture is lean. The lambda value, or the air excess coefficient as it is also called, is the actual amount of air supplied divided by the amount of air theoretically necessary for complete combustion. If the lambda value is greater than one, the air/fuel mixture is lean; if the lambda value is less than one, the air/fuel mixture is rich.

It is possible to carefully control the fuel supplied from a fuel injection valve with the aid of the internal combustion engine fuel injection system, thereby obtaining a substantially constant lambda value for the air/fuel mixture supplied. However, when the internal combustion engine is cold, fuel condenses on the comparatively cold walls in the intake channel and in the cylinder. The fuel condensed on the walls evaporates during idling, following the air/fuel mixture that flows into the intake channel and is supplied to the cylinder space. If the evaporation of the fuel condensed on the walls is uneven, for example, on account of pressure changes, temperature gradients or the flow velocity of the air/fuel mixture in the intake channel, there will be a variation in the lambda value of the air/fuel mixture supplied to the cylinder space.

Since the torque provided by the internal combustion engine varies during idling upon a cold start, the rotation speed of the internal combustion engine also varies. The rotation speed of the internal combustion engine here means the crankshaft rotation speed of the internal combustion engine. When the rotation speed varies, the pressure in the intake channel also varies, which in turn leads to the evaporation of the condensed fuel varying so that there is a variation in the lambda value of the air/fuel mixture supplied to the cylinder space. The uneven rotation speed of the internal combustion engine is thereby intensified.

SUMMARY OF INVENTION

The present invention reduces harmful and toxic exhaust gases from an internal combustion engine upon cold starts. Further, the present invention allows an internal combustion engine to operate with a substantially constant rotation speed upon idling when a lean air/fuel mixture is supplied to the internal combustion engine.

This is achieved by the present invention with a method comprising supplying an air/fuel mixture with a lambda value of greater than one to the cylinder, and controlling the pressure in the intake channel by means of an electric motor/generator coupled to the crankshaft, so that when the pressure in the intake channel exceeds a predetermined pressure, the electric motor/generator is controlled so that the pressure in the intake channel can decrease, and when the pressure in the intake channel falls below a predetermined pressure, the electric motor/generator is controlled so that the pressure in the intake channel can increase.

By controlling the pressure in the intake channels of the internal combustion engine with the aid of an electric motor/generator, the pressure in the intake channels can be maintained substantially constant. The lambda value of the air/fuel mixture supplied to the cylinders is thus maintained substantially constant, meaning that the torque provided by the internal combustion engine is substantially constant. The rotation speed of the internal combustion engine will also be substantially constant, meaning that harmful and toxic exhaust gases, particularly hydrocarbons, from the internal combustion engine decrease.

BRIEF DESCRIPTION OF DRAWINGS

The invention will be explained in greater detail below on the basis of an illustrative embodiment which is shown in the attached drawings, where.

DETAILED DESCRIPTION

Figure 1:
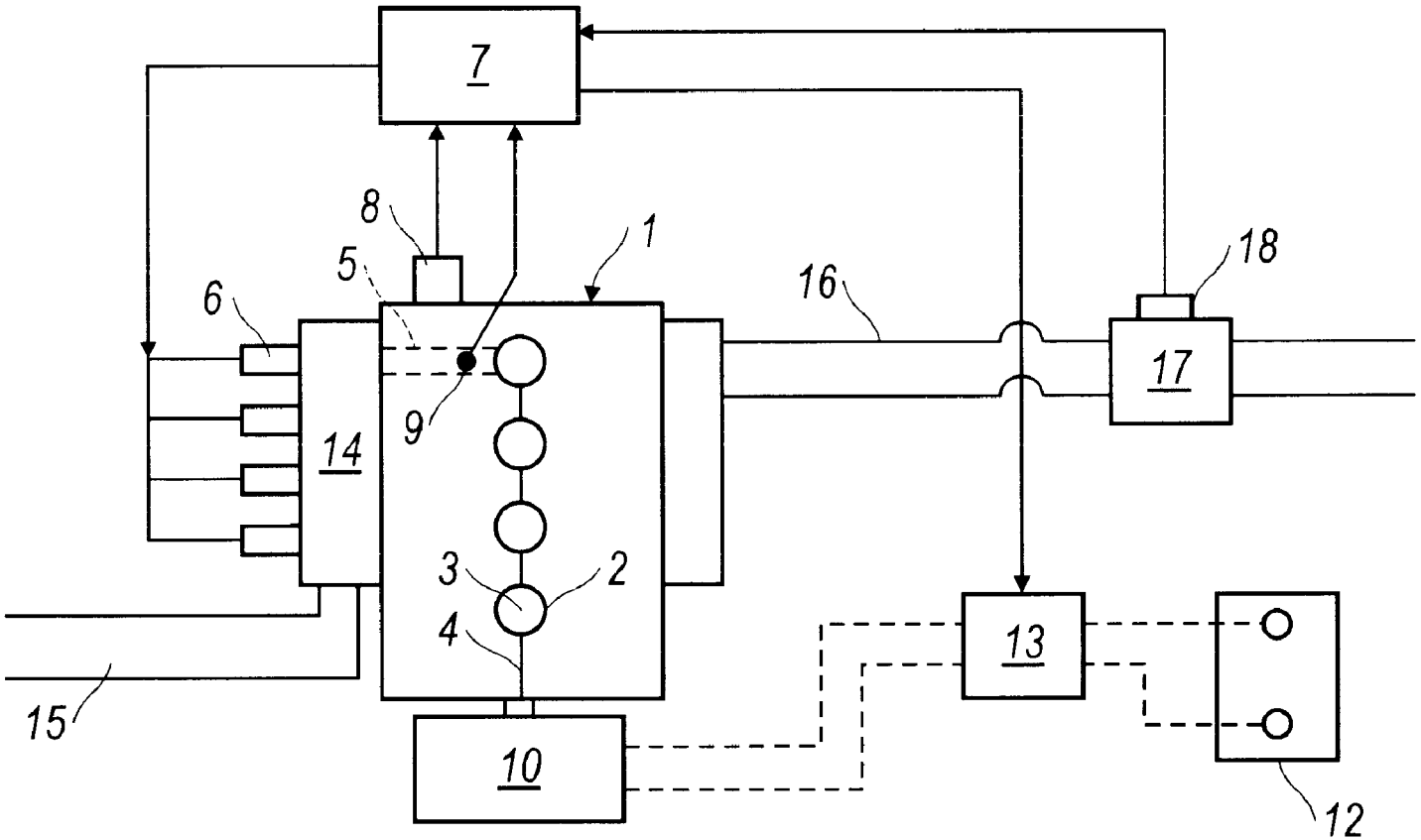
FIG. 1 is a schematic diagram of an internal combustion engine and an electric motor/generator for carrying out the method according to an embodiment of the present invention.

FIG. 1 provides a schematic diagram of an internal combustion engine 1 having four cylinders 2. Arranged in each cylinder 2 there is a reciprocating piston 3 that is connected to a rotatable crankshaft 4. Connected to each cylinder 2 there is at least one intake channel 5. Although only one intake channel 5 is shown in FIG. 1, it should be understood that there can be multiple channels. Connected to the intake channels 5 there are fuel injection nozzles 6 that are controlled by a control unit 7. The control unit 7 is also coupled to a number of sensors 8 in the internal combustion engine 1. The sensors can detect the temperature of the internal combustion engine 1, its rotation speed, etc. It is also possible to arrange pressure sensors 9 in the intake channels 5 for detecting the pressure in the intake channels 5. As illustrated, these pressure sensors 9 are connected to the control unit 7.

An electric motor/generator 10, which functions as an integrated starting motor and generator (ISG), is coupled to the crankshaft 4 of the internal combustion engine 1. As an alternative to direct coupling of the electric motor/starting motor 10 to the crankshaft 4, it is possible to use a belt, chain or gearwheel transmission for coupling the electric motor/generator 10 to the crankshaft 4. The electric motor/generator 10 is connected to a battery 12 via a control device 13. The control device 13 is connected to the control unit 7 and receives information from the control unit 7 on how the electric motor/generator 10 is to be driven.

When the internal combustion engine 1 is in operation, air arrives at an intake manifold 14 via an air inlet pipe 15. From the inlet manifold 14, the air flows onward to the intake channels 5 where the air is mixed with fuel that is injected into the intake channels 5 by means of the fuel injection nozzles 6. The air/fuel mixture then flows into the cylinders 2 and is ignited by an ignition plug (not shown) arranged in each cylinder 2. Lastly, the combusted air/fuel mixture in the form of exhaust gases runs off into the atmosphere through an exhaust gas system 16 connected to the internal combustion engine 1.

As has been explained above, the combusted air/fuel mixture contains substances which can adversely effect the surrounding environment. These substances include CO, HC and $NO_x$. Therefore, the exhaust gases are treated in a catalytic converter 17 that is arranged in the exhaust gas system 16 and that converts the substances to that which does not adversely affect the environment. However, the catalytic converter 17 functions only when it has achieved a certain operating temperature, which is reached after a certain warming-up time after starting the internal combustion engine 1. Therefore, upon cold-starting of the internal combustion engine 1, no conversion of the abovementioned substances takes place in the catalytic converter 17.

The amount of CO, HC and $NO_x$ in the exhaust gases depends, inter alia, on the mixing ratio of the air/fuel mixture supplied to the cylinders 2. This mixing ratio is usually indicated by a lambda value. The lambda value, or the air excess coefficient as it is also known, is the actual amount of air supplied, divided by the theoretically necessary amount of air. If the lambda value is greater than one, the air/fuel mixture is lean; if the lambda value is less than one, the air/fuel mixture is rich.

By supplying the cylinders 2 with an air/fuel mixture having a lambda value greater than one, i.e., a lean air/fuel mixture, when cold-starting the internal combustion engine 1, the level of HC in the exhaust gases can be substantially reduced. If a lean air/fuel mixture is supplied to the internal combustion engine 1 when it is cold, i.e., when the internal combustion engine 1 has not reached its operating temperature, problems involving an uneven rotation speed arise during idling, as explained above. By controlling the electric motor/generator 10 so that the pressure in the intake channels 5 is maintained substantially constant, as is proposed according to the present invention, it is possible to achieve a substantially constant rotation speed of the internal combustion engine 1 when the internal combustion engine 1 is cold and is being driven with an air/fuel mixture which is lean.

Figure 2:
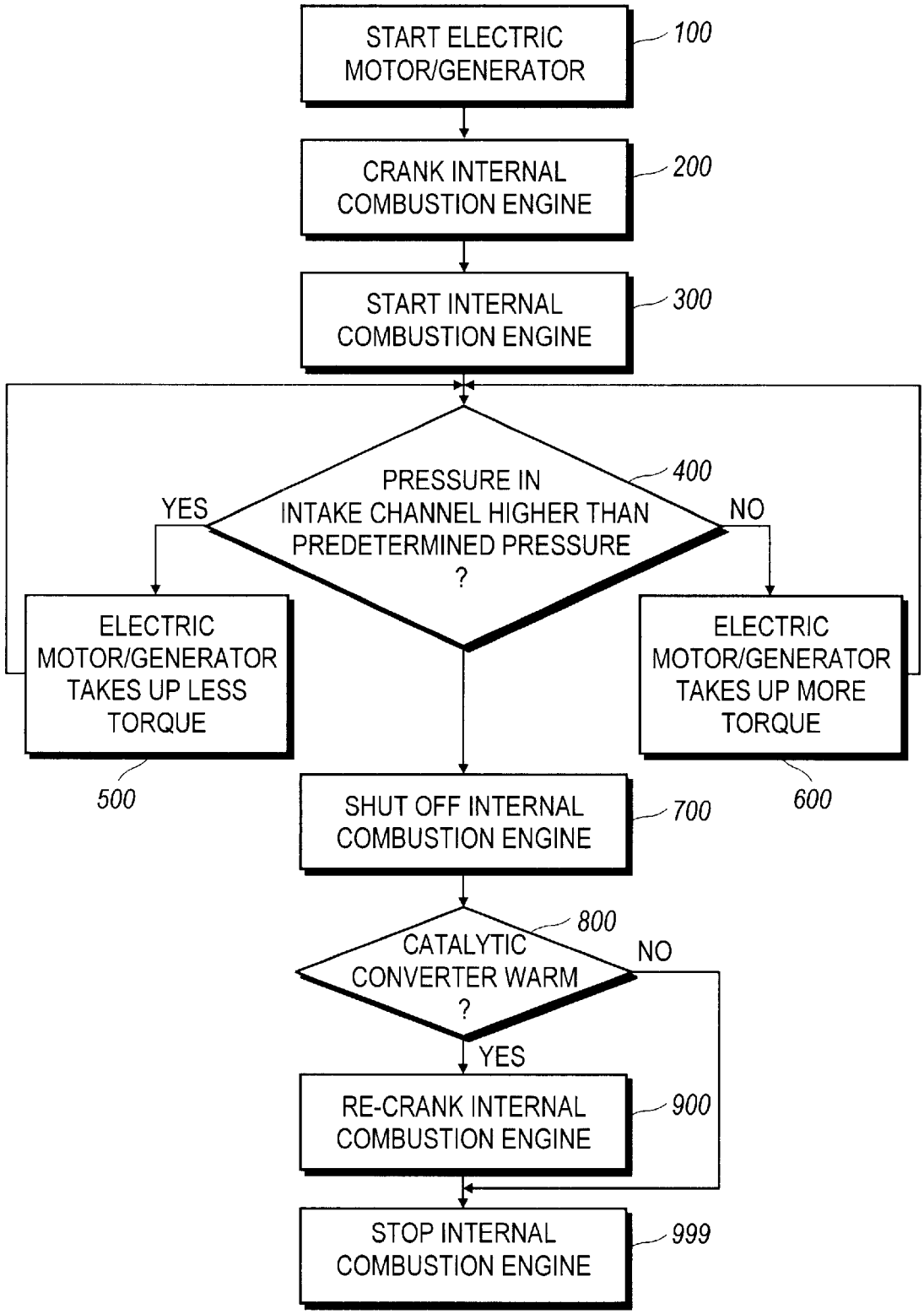
FIG. 2 illustrates a flow chart representing the method according to an embodiment of the present invention.

The method according to the present invention, the steps of which one embodiment are illustrated in FIG. 2, is as follows. When starting the internal combustion engine 1, the electric motor/generator 10 is first activated, as shown in step 100. This drives the crankshaft 4 of the internal combustion engine 1 as noted in step 200. As such, the electric motor/generator 10 functions as a starter motor for the internal combustion engine 1, indicated by step 300. At the same time, fuel and air ignited in the cylinders 2 are supplied so that the crankshaft 4 rotates. In order to reduce the HC that occur in the exhaust gases, the cylinders 2 are supplied with a lean air/fuel mixture having a lambda value of between about 1.1 and about 1.4, preferably between about 1.1 and about 1.2.

However, when the internal combustion engine 1 is cold, fuel condenses on the comparatively cold walls of the intake channels 5. The condensed fuel is evaporated during idling of the internal combustion engine 1 and follows the air/fuel mixture, which flows into the intake channels 5 and is supplied to the cylinders 2. The evaporation of the fuel condensed on the walls is uneven due to pressure changes in the intake channels 5. This results in a variation in the lambda value of the air/fuel mixture supplied to the cylinders 2.

Since the torque provided by the internal combustion engine 1 varies during idling at a cold start, the rotation speed of the internal combustion engine 1 varies. As mentioned above, the rotation speed of the internal combustion engine 1 here means the crankshaft 4 rotation speed of the internal combustion engine 1. When the rotation speed varies, the pressure in the intake channels 5 also varies, resulting in the evaporation of the fuel condensed on the intake channels 5 also varying so that there is a variation in the lambda value of the air/fuel mixture supplied to the cylinders 2. The uneven rotation speed of the internal combustion engine 1 is thus intensified.

Referring to step 400, by controlling the pressure in the intake channels 5 with the aid of the electric motor/generator 10 coupled to the crankshaft 4, when the pressure in the intake channels 5 exceeds a predetermined pressure, the electric motor/generator 10 drives the crankshaft 4 in order to reduce the pressure in the intake channels 5. This pressure reduction is achieved by means of the pistons 3 in the cylinders 2 generating an underpressure in the cylinders 2 during the intake stroke. The underpressure generated in the cylinders 2 will also be generated in the intake channels 5. When the electric motor/generator 10 drives the crankshaft 4, the rotation speed of the crankshaft 4 increases so that the underpressure generated in the cylinders 2 falls, meaning that the pressure in the intake channels 5 falls, as generally indicated by step 500. When the pressure in the intake channels 5 falls below a predetermined pressure, the crankshaft 4 drives the electric motor/generator 10 so that the crankshaft 4 rotation speed decreases, meaning that the pressure in the intake channels 5 increases, as generally indicated by step 600. When the pressure in the intake channels 5 falls, the evaporation of fuel on the walls of the intake channels 5 increases. This leads to relatively more fuel being supplied to the cylinders 3 since the air/fuel mixture is richer. Therefore, there is an increase in the torque of the crankshaft 4, leading to an increased crankshaft 4 rotation speed. The electric motor/generator 10 will then take up this torque increase by means of the crankshaft 4 driving the electric motor/generator 10, thereby braking the crankshaft 4. With this method, a substantially constant pressure can be obtained in the intake channels 5. A pressure sensor 9 can preferably be arranged in at least one of the intake channels 5 in order to measure the pressure in the intake channels 5. The pressure sensor 9 is coupled to the control unit 7 of the internal combustion engine 1, with the control unit 7 sending signals to a control device 13 for the electric motor/generator 10.

By controlling the pressure in the intake channels 5 of the internal combustion engine 1 with the aid of the electric motor/generator 10, the pressure in the intake channels 5 can be maintained substantially constant. The lambda value of the air/fuel mixture supplied to the cylinders 2 is thus maintained substantially constant, meaning that the torque provided by the internal combustion engine 1 will be substantially constant. The rotation speed of the internal combustion engine 1 is thus also substantially constant.

As noted above, FIG. 2 shows a flow chart representing the steps of method of the present invention. When the electric motor/generator 10 has started in step 100, it is possible to rotate the internal combustion engine 1 crankshaft 4 through one or more turns, without fuel and air being supplied to the cylinders 2 and with the aid of the electric motor/generator 10, for the purpose of generating an underpressure in the intake channels 5. This is generally referred to as cranking the internal combustion engine 1, indicated by step 200. When the air/fuel mixture is finally supplied in order to start the internal combustion engine 1 in step 300, a more powerful evaporation of the fuel in the intake channels 5 occurs than would be possible if an underpressure had not been generated by cranking. The more powerful evaporation of the fuel leads to the HC being reduced in the exhaust gases at start-up. The $NO_x$ also decrease at start-up due to the combustion pressure in the cylinders 2 decreasing as a result of the cranking.

When the combustion engine 1 is shut off in step 700, a temperature sensor 18 arranged on the catalytic converter 17 detects the temperature of the catalytic converter 17. Referring to step 800, if the temperature of the catalytic converter 17 corresponds to or exceeds a predetermined temperature, the electric motor/generator 10 drives the crankshaft 4 for a period of time without fuel being supplied to the internal combustion engine 10, as indicated in step 900, thereby ventilating the fuel present in the intake channels 5 and the cylinders 2. Preferably, the predetermined temperature corresponds to the operating temperature of the catalytic converter 17. In this manner, the fuel ventilated in the intake channels 5 and the cylinders 2 is evaporated in the exhaust gas system 16 of the internal combustion engine 1, and HC are reduced in the warm catalytic converter 17, wherein after the internal combustion engine 1 and its crankshaft 4 are stopped as shown by step 999. The next time the internal combustion engine 1 is started, there will therefore be no uncombusted fuel in the intake channels 5 and cylinders 2 that increases the level of HC in the exhaust gases.

Figure 3:
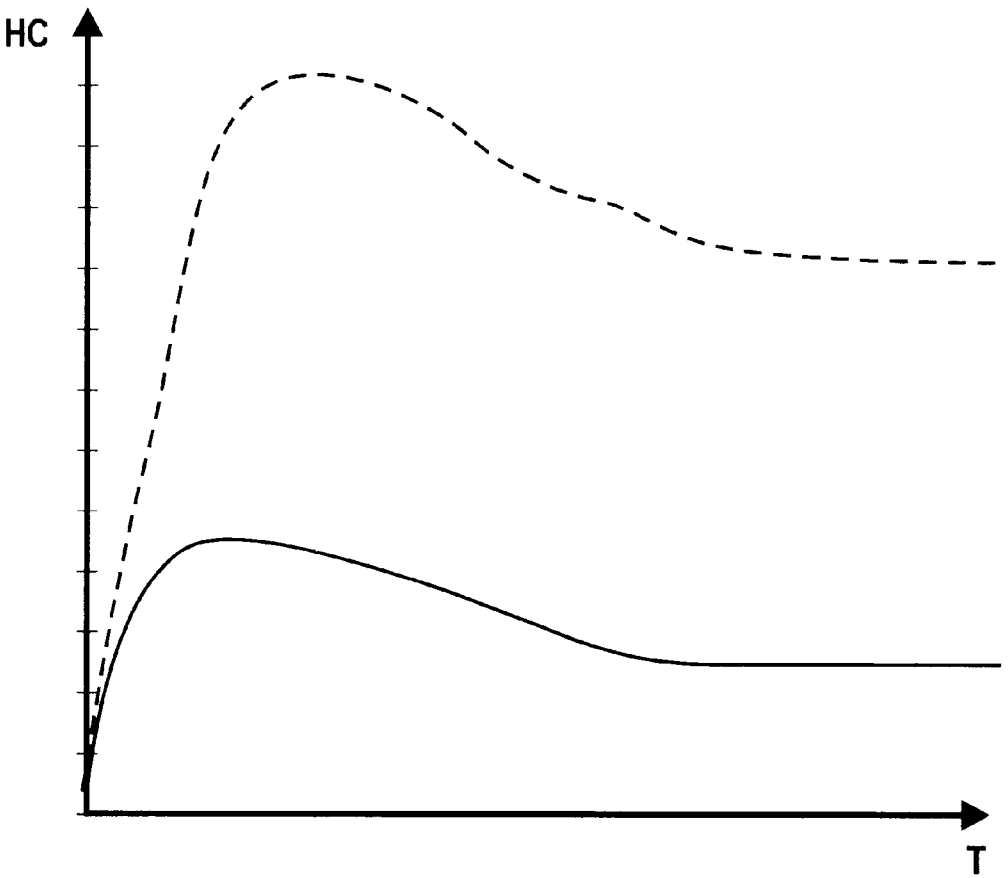
FIG. 3 illustrates a diagram of the HC content in the exhaust gases as a function of time for an internal combustion engine driven using the method according to the present invention, and for an internal combustion engine driven according to conventional methods.

FIG. 3 shows a diagram of the HC content, i.e., the content of hydrocarbons in the exhaust gases as a function of time T for an internal combustion engine 1 driven using the method according to the present invention and for an internal combustion engine driven according to conventional methods. The solid line represents an internal combustion engine 1 driven using the method according to the present invention, and the broken line represents an internal combustion engine driven according to conventional methods. Tests have shown that the HC level is 5 to 10 times lower in an internal combustion engine 1 driven using the method according to the present invention than in an internal combustion engine driven according to conventional methods.

Although the present invention has been described and illustrated in detail, it is to be clearly understood that the same is by way of illustration and example only, and is not to be taken as a limitation. The spirit and scope of the present invention are to be limited only by the terms of any claims presented hereafter.

What is claimed is:

1. A method for reducing harmful and toxic exhaust gases from an internal combustion engine having at least one cylinder supplied by an air/fuel mixture when a crankshaft of the internal combustion engine rotates, comprising the steps of:

supplying an air/fuel mixture with a lambda value of greater than one to the cylinder, and controlling the pressure in the intake channel by means of an electric motor/generator coupled to the crankshaft, wherein when the pressure in the intake channel exceeds a predetermined pressure, the electric motor/generator is controlled so that the pressure in the intake channel can decrease, and when the pressure in the intake channel falls below a predetermined pressure, the electric motor/generator is controlled so that the pressure in the intake channel can increase.

2. The method according to claim 1 wherein the pressure in the intake channel is maintained substantially constant by controlling the electric motor/generator such that the crankshaft rotates at a substantially constant rotation speed.

3. The method according to claim 1 wherein the electric motor/generator drives the crankshaft for a predetermined time without fuel being supplied to the internal combustion engine, thereby generating an underpressure in the intake channel before the internal combustion engine is started.

4. The method according to claim 1, further comprising the step of detecting the temperature of a catalyzer arranged on the internal combustion engine, wherein when the temperature of the catalyzer corresponds to or exceeds a predetermined temperature, the electric motor/generator drives the crankshaft for a predetermined time without fuel being supplied to the internal combustion engine, thereby ventilating fuel present in the intake channel and the cylinder.

5. The method according to claim 1 further comprising the step of controlling the internal combustion engine by a control unit which receives signals from the internal combustion engine and which emits signals to a control device for the electric motor/generator.

6. The method according to claim 1 wherein the lambda value of the air/fuel mixture supplied to the cylinder lies in the range of about 1.1 to about 1.4.

7. The method according to claim 6 wherein the lambda value of the air/fuel mixture supplied to the cylinder lies in the range of about 1.1 to about 1.2.

8. The method according to claim 1 wherein the method is used for cold starting of the internal combustion engine.

9. A method for reducing harmful and toxic exhaust gases from an internal combustion engine having at least one cylinder supplied by an air/fuel mixture when a crankshaft of the internal combustion engine rotates, comprising the steps of:

supplying an air/fuel mixture with a lambda value of greater than one to the cylinder, and controlling the pressure in the intake channel by means of an electric motor/generator coupled to the crankshaft, wherein when the pressure in the intake channel exceeds a predetermined pressure, the electric motor/generator is controlled so that the pressure in the intake channel can decrease, and when the pressure in the intake channel falls below a predetermined pressure, the electric motor/generator is controlled so that the pressure in the intake channel can increase, and wherein the method is used for cold starting of the internal combustion engine.

10. A method for reducing harmful and toxic exhaust gases from an internal combustion engine having at least one cylinder supplied by an air/fuel mixture when a crankshaft of the internal combustion engine rotates, the method comprising the steps of:

supplying an air/fuel mixture with a lambda value of greater than one to the cylinder, and controlling the pressure in the intake channel by means of an electric motor/generator coupled to the crankshaft, wherein when the pressure in the intake channel exceeds a predetermined pressure, the electric motor/generator is controlled so that the pressure in the intake channel can decrease, and wherein when the pressure in the intake channel falls below a predetermined pressure, the electric motor/generator is controlled so that the pressure in the intake channel can increase, whereby the lambda value of the air/fuel mixture supplied to the cylinder is maintained substantially constant.

11. A method for reducing harmful and toxic exhaust gases from an internal combustion engine having at least one cylinder supplied by an air/fuel mixture when a crankshaft of the internal combustion engine rotates, the method comprising the steps of:

supplying an air/fuel mixture with a lambda value of greater than one to the cylinder, controlling the pressure in the intake channel by means of an electric motor/generator coupled to the crankshaft, and driving the crankshaft with the electric motor/generator for a predetermined time without supplying fuel to the internal combustion engine, thereby generating an under pressure in the intake channel before the internal combustion engine is started, wherein when the pressure in the intake channel exceeds a predetermined pressure, the electric motor/generator is controlled so that the pressure in the intake channel can decrease, and when the pressure in the intake channel falls below a predetermined pressure, the electric motor/generator is controlled so that the pressure in the intake channel can increase.

12. The method according to claim 11 wherein the pressure in the intake channel is maintained substantially constant by controlling the electric motor/generator such that the crankshaft rotates at a substantially constant rotation speed.

13. The method according to claim 11, further comprising the step of detecting the temperature of a catalyzer arranged on the internal combustion engine, wherein when the temperature of the catalyzer corresponds to or exceeds a predetermined temperature, the electric motor/generator drives the crankshaft for a predetermined time without supplying fuel to the internal combustion engine, thereby ventilating fuel present in the intake channel and the cylinder.

14. The method according to claim 11, further comprising the step of controlling the internal combustion engine by a control unit that receives signals from the internal combustion engine and emits signals to a control device for the electric motor/generator.

15. The method according to claim 11 wherein the lambda value of the air/fuel mixture supplied to the cylinder lies in the range of about 1.1 to about 1.4.

16. The method according to claim 15 wherein the lambda value of the air/fuel mixture supplied to the cylinder lies in the range of about 1.1 to about 1.2.

17. The method according to claim 11 wherein the method is used for cold starting of the internal combustion engine.

18. A method for reducing harmful and toxic exhaust gases from an internal combustion engine having at least one cylinder supplied by an air/fuel mixture when a crankshaft of the internal combustion engine rotates, the method comprising the steps of:

supplying an air/fuel mixture with a lambda value of greater than one to the cylinder, controlling the pressure in the intake channel by means of an electric motor/generator coupled to the crankshaft, and detecting the temperature of a catalyzer arranged on the internal combustion engine, wherein when the temperature of the catalyzer corresponds to or exceeds a predetermined temperature, the electric motor/generator drives the crankshaft for a predetermined time without supplying fuel to the internal combustion engine, thereby ventilating fuel present in the intake channel and the cylinder, and wherein when the pressure in the intake channel exceeds a predetermined pressure, the electric motor/generator is controlled so that the pressure in the intake channel can decrease, and when the pressure in the intake channel falls below a predetermined pressure, the electric motor/generator is controlled so that the pressure in the intake channel can increase.

19. The method according to claim 18 wherein the pressure in the intake channel is maintained substantially constant by controlling the electric motor/generator such that the crankshaft rotates at a substantially constant rotation speed.

20. The method according to claim 18, further comprising the step of driving the crankshaft with the electric motor/generator for a predetermined time without supplying fuel to the internal combustion engine, thereby generating an under pressure in the intake channel before the internal combustion engine.

21. The method according to claim 18, further comprising the step of controlling the internal combustion engine by a control unit that receives signals from the internal combustion engine and emits signals to a control device for the electric motor/generator.

22. The method according to claim 18 wherein the lambda value of the air/fuel mixture supplied to the cylinder lies in the range of about 1.1 to about 1.4.

23. The method according to claim 18 wherein the lambda value of the air/fuel mixture supplied to the cylinder lies in the range of about 1.1 to about 1.2.

24. The method according to claim 18 wherein the method is used for cold starting of the internal combustion engine.

* * * * *